US010117025B2

(12) United States Patent
Epping

(10) Patent No.: US 10,117,025 B2
(45) Date of Patent: Oct. 30, 2018

(54) ELECTRODYNAMIC SOUND TRANSDUCER

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 9 days.

(21) Appl. No.: 15/319,078

(22) PCT Filed: Jun. 11, 2015

(86) PCT No.: PCT/EP2015/063004
§ 371 (c)(1),
(2) Date: Dec. 15, 2016

(87) PCT Pub. No.: WO2015/193160
PCT Pub. Date: Dec. 23, 2015

(65) Prior Publication Data

US 2017/0134861 A1 May 11, 2017

(30) Foreign Application Priority Data

Jun. 18, 2014 (DE) ..... 10 2014 211 687

(51) Int. Cl.

| | |
|---|---|
| ***H04R 9/06*** | (2006.01) |
| ***H04R 9/04*** | (2006.01) |
| ***H04R 9/02*** | (2006.01) |
| ***H04R 7/12*** | (2006.01) |

(52) U.S. Cl.
CPC ..... *H04R 9/047* (2013.01); *H04R 7/127* (2013.01); *H04R 9/025* (2013.01); *H04R 9/06* (2013.01)

(58) Field of Classification Search
CPC ..... H04R 9/025; H04R 9/046; H04R 9/047; H04R 2209/024
See application file for complete search history.

(56) References Cited

U.S. PATENT DOCUMENTS 3,013,905 A * 12/1961 Koura ..... B06B 1/04 381/427
4,468,530 A * 8/1984 Torgeson ..... H04R 9/047 381/402

(Continued)

FOREIGN PATENT DOCUMENTS

| | | |
|---|---|---|
| DE | 43 17 775 | 8/1994 |
| EP | 1 434 463 | 6/2004 |
| JP | H01-226299 | 9/1989 |

OTHER PUBLICATIONS

International Search Report for Application No. PCT/EP2015/063004 dated Sep. 24, 2015.

*Primary Examiner* — Matthew Eason
*Assistant Examiner* — Ryan Robinson
(74) *Attorney, Agent, or Firm* — Haug Partners LLP

(57) ABSTRACT

An electrodynamic sound transducer has a diaphragm, a dome and a surround and a voice coil. The sound transducer further has a first magnet ring and a second magnet ring as part of the magnet system, the first magnet ring and second magnet ring being arranged on opposite sides of the diaphragm. The voice coil is coupled with the diaphragm and is arranged approximately on or outside of the circumference of the first magnet ring and second magnet ring.

5 Claims, 5 Drawing Sheets

(56) References Cited

U.S. PATENT DOCUMENTS

| | | | | |
|---|---|---|---|---|
| 4,803,733 | A * | 2/1989 | Carver | H04R 7/18 181/172 |
| 6,636,612 | B1 | 10/2003 | North et al. | |
| 7,020,301 | B2 * | 3/2006 | Koura | H04R 7/04 381/399 |
| 7,231,058 | B2 * | 6/2007 | Usuki | H04R 9/025 381/408 |
| 7,885,425 | B2 * | 2/2011 | Matsumura | H04R 9/025 381/414 |
| 8,238,585 | B2 * | 8/2012 | Wang | H03F 9/00 381/152 |
| 8,630,440 | B2 * | 1/2014 | Dickie | H04R 7/127 181/171 |
| 8,942,408 | B1 * | 1/2015 | Croft, III | H01F 7/0289 381/152 |
| 2008/0019558 | A1 | 1/2008 | Simidian, II et al. | |
| 2012/0051557 | A1 * | 3/2012 | Horigome | H04R 9/047 381/86 |
| 2017/0034628 | A1 * | 2/2017 | Mao | H04R 9/025 |

* cited by examiner

ELECTRODYNAMIC SOUND TRANSDUCER

The present application claims priority from International Patent Application No. PCT/EP2015/063004 filed on Jun. 11, 2015, which claims priority from German Patent Application No. 10 2014 211 687.2 filed on Jun. 18, 2014, the disclosures of which are incorporated herein by reference in their entirety.

FIELD OF THE INVENTION

It is noted that citation or identification of any document in this application is not an admission that such document is available as prior art to the present invention.

The present invention is directed to an electrodynamic sound transducer.

FIG. 9A shows a schematic diagram of an electrodynamic sound transducer according to the prior art. The sound transducer has a diaphragm 140 with a voice coil 130 and a magnet system 110. The diaphragm 140 has a surround area and a dome area. An air gap is formed through the magnet system, the voice coil 130 extending therein in axial direction. The voice coil is configured such that it is located in the air gap even during maximum permissible excursion. However, in the electrodynamic sound transducer shown in FIG. 9A, the voice coil has a large mass so that it has a poorer transient response compared, e.g., to an electrostatic sound transducer. Due to the length of the voice coil, many windings of the voice coil are not in the actual useful flux of the air gap and therefore cannot contribute to the electromechanical sound conversion. Further, unwanted resonances occur due to the acoustical mass of the remaining slots in the air gap between the voice coil and the pole piece or cup. At higher amplitudes, the air must be pressed through the remaining slots in the air gap between the voice coil and the pole piece or cup, which can lead to unwanted air flow effects. Because of the expansion of the voice coil in axial direction, a wobbling movement of the diaphragm may come about through the lever effect of the large excursion of the voice coil in radial direction. This can lead to unwanted and premature knocking of the coil against the magnet system.

FIG. 9B shows a graph illustrating the Bl factor as a function of excursion. The Bl factor in the region of the air gap is shown in particular. The amplitude of the Bl factor drops appreciably both above and below the pole piece or neutral position R. Further, the curve varies above, o, and below, u, the pole piece.

US 2008/0019558 A1 shows an orthodynamic or planar magnetic sound transducer. The transducer has a straight diaphragm and magnets which are arranged opposite one another by pairs. The magnetization of the magnets is effected such that two magnetic North poles face one another or two magnetic South poles face one another. The polarization is reversed in the neighboring magnet pair. This results in a magnetic field that extends parallel to the diaphragm. As a result of the arrangement of the magnet pairs, the magnetization direction of the magnetic field in gaps between the neighboring magnet pairs is reversed in the magnetization direction. Because of the configuration of the magnets and the straight diaphragm, the diaphragm can be driven at many points simultaneously. On the other hand, the arrangement of the magnets in front of and behind the diaphragm causes a reduction in the available installation space that cannot be used for the further acoustical layout of the transducer. As the quantity of magnets increases, so also does the repulsive force of opposing magnets which must be contained by the design. The free sound path is further limited because the sound waves must pass through the space remaining between the magnets, which may entail a high acoustical stress on the diaphragm. In this respect, the diaphragm is loaded by an additional acoustical mass, which negatively affects the frequency response of the transducer in the higher frequency range. Cancellations and phase differences may occur as a result of the excitation at various points of the diaphragm.

The German Patent and Trademark Office searched the following documents in the German patent application upon which priority is based: DE 43 17 775 A1, U.S. Pat. No. 6,636,612 B1 and US 2008/0019558 A1.

SUMMARY OF THE INVENTION

It is the object of the invention to provide an improved electrodynamic sound transducer.

The invention is directed to an electrodynamic sound transducer with a diaphragm having a dome and a surround. The diaphragm forms a closed surface. The sound transducer further has a voice coil which is fastened to the diaphragm. The sound transducer further has a first magnet ring on one side of the diaphragm and a second magnet ring on the other side of the diaphragm. The first magnet ring defines a first plane and the second magnet ring defines a second plane. The voice coil or the dome is arranged in the area between the first plane and second plane. The magnetization direction of the first magnet ring is opposite to the magnetization direction of the second magnet ring.

According to a further aspect of the present invention, the first magnet ring is angled or beveled at its side facing the diaphragm. The second magnet ring is beveled at its side facing the diaphragm.

According to a further aspect of the present invention, an inner diameter of the voice coil substantially corresponds to the outer diameter of the first magnet ring and/or second magnet ring.

According to a further aspect of the present invention, the first magnet ring is arranged in a resonator and the second magnet ring is arranged on a frame of the transducer.

According to a further aspect of the present invention, a diameter of the first magnet ring is equal to the diameter of the second magnet ring.

According to a further aspect of the present invention, the diaphragm has a flat dome or a flat coil seat.

According to a further aspect of the present invention, the voice coil and/or the lead to the voice coil are/is printed on the diaphragm.

According to the invention, an electrodynamic sound transducer with a diaphragm, a dome, a surround and a voice coil is provided. The sound transducer further has a first magnet ring and second magnet ring as part of the magnet system, and the first magnet ring and second magnet ring are arranged, respectively, on the opposite side of the diaphragm. The voice coil is coupled with the diaphragm and is arranged on or somewhat outside of the circumference of the first magnet ring and second magnet ring.

This is advantageous because the magnetic field lines have the correct orientation precisely at this location. The first magnet ring and second magnet ring are arranged with like poles opposite one another. As a result of the arrangement of the magnets and the selected magnetization direction, there results at the edge of the magnets a field curve that is substantially parallel to the diaphragm and oriented radial to the center of the transducer. The voice coil is preferably arranged precisely at this location. Accordingly, the motive force of the diaphragm results perpendicular to the diaphragm when current passes through.

According to the invention, an electrodynamic sound transducer is provided which has a diaphragm with a dome and a surround and a voice coil. At least two magnet rings are arranged on both sides of the diaphragm with like poles facing one another. The voice coil is radially offset with respect to the center of the magnet rings and lies in an area in which the magnetic field lines are substantially perpendicular to the coil.

According to an aspect of the present invention, the diaphragm can be constructed with a flat dome. Alternatively or in addition, the diaphragm can be formed so as to be flat in the region of the coil seat.

The electrodynamic sound transducer according to the invention can be used as a receiving transducer and as a reproduction transducer.

According to an aspect of the present invention, the voice coil can be printed on the diaphragm. The electrical contacting of the voice coil can be carried out via the diaphragm surround and can likewise be printed.

According to the invention, the diaphragm forms a closed surface. According to the invention, a first magnet ring can be provided on one side of the closed diaphragm surface and a second magnet ring can be provided on the second side of the closed diaphragm surface, so that the second side is opposite the first side.

According to the invention, the first diaphragm ring defines a first plane, the second diaphragm ring defines a second plane, and the dome is arranged between the first plane and second plane.

According to an aspect of the present invention, the coil can be provided between the first plane and second plane which are defined by the first magnet ring and second magnet ring.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
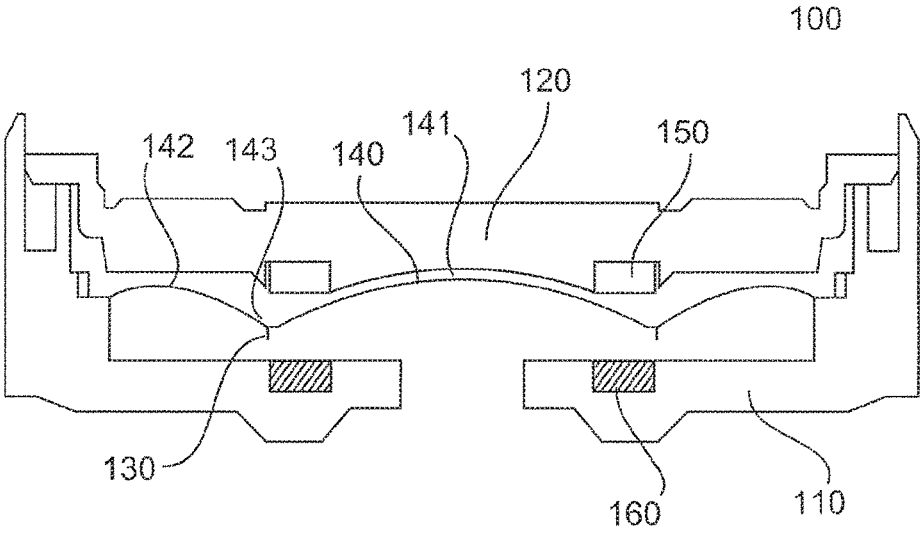
FIG. 1 shows a schematic sectional view of an electrodynamic sound transducer according to a first embodiment example.

FIG. 1 shows a schematic sectional view of an electrodynamic sound transducer according to a first embodiment example. The electrodynamic sound transducer 100 optionally has a frame 110 and a resonator 120, and has a diaphragm 140 with a dome 141 and a surround 142. There is provided in the area between the dome 141 and the surround 142, an area 143 at which a voice coil 130 is provided. The electrodynamic sound transducer 100 further has a first magnet ring 150 and second magnet ring 160 which are provided on opposite sides of the diaphragm. The first magnet ring 150 and second magnet ring 160 have the same diameter, for example. The voice coil 130 is provided at the outer edge of the first magnet ring 150 and second magnet ring 160. The first magnet ring 150 and second magnet ring 160 are arranged with like poles facing one another. The first magnet ring 150 and second magnet ring 160 are installed in such a way that the magnetization direction is opposed. Accordingly, the first magnet ring 150 and second magnet ring 160 repel one another. Optionally, the first magnet ring 150 can be provided in the resonator 120 and the second magnet ring 160 can be provided in the frame 110.

The voice coil 130 has at least one winding. Optionally, the coil can be formed of a plurality of windings next to one another. Accordingly, the height of the coil corresponds to the height of the coil wire diameter. Optionally, the coil can also have different dimensions in order to compromise between a small mass and a large conductor length. A large conductor length is advantageous for improved sensitivity. According to the invention, the coil is constructed so as to be flat. The voice coil can be printed on the diaphragm, for example.

The diaphragm 140 forms a closed surface and has a dome 141 and a surround 142. The first magnet ring defines a first plane, and the second magnet ring defines a second plane. The voice coil and/or the dome are/is arranged in the area between the first plane and the second plane.

Figure 2:
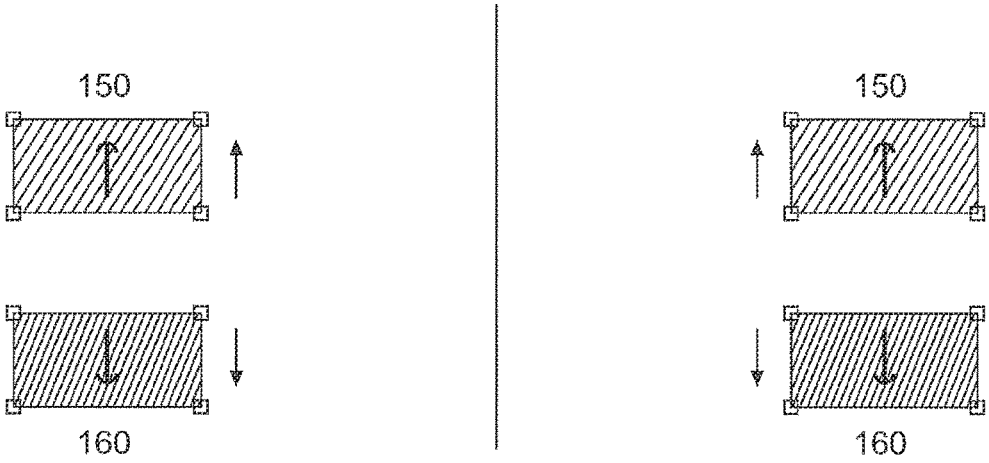
FIG. 2 shows a schematic diagram of two magnet rings in the electrodynamic sound transducer according to the first embodiment example.

FIG. 2 shows a schematic diagram of a first magnet ring and second magnet ring in an electrodynamic sound transducer according to the first embodiment example. It is clear that the magnetization direction of the first magnet ring 150 is opposite to the magnetization direction of the second magnet ring 160.

Figure 3:
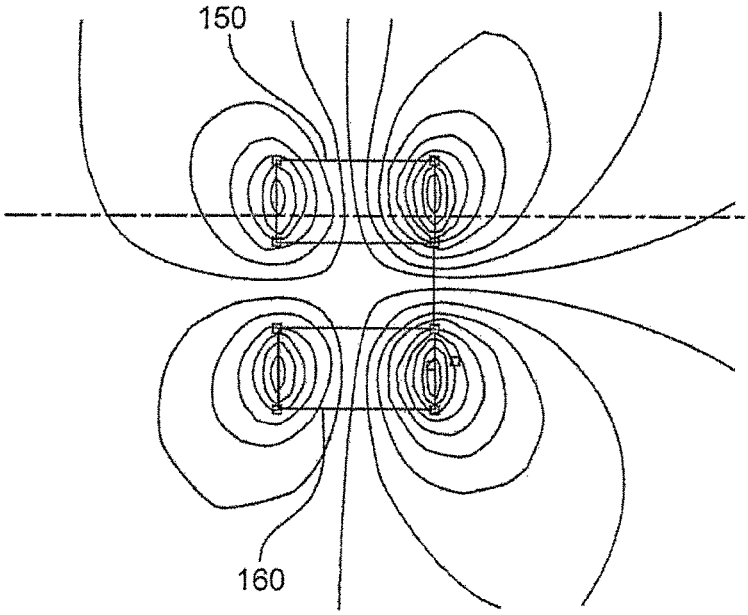
FIG. 3 shows a schematic diagram of two magnet rings and the magnetic field lines in an electrodynamic sound transducer according to the first embodiment example.

FIG. 3 shows a schematic diagram of the first magnet ring and second magnet ring and the field lines of the magnetic field of the first magnet ring 150 and second magnet ring 160. It will be seen that the magnetic field lines at the points to the left and right of the first magnet ring 150 and second magnet ring 160 run substantially parallel to a diaphragm 140 to be provided there. In particular, there are field lines oriented perpendicular to the voice coil between the first magnet ring 150 and second magnet ring 160 on the outer diameter of the magnet rings 150, 160. Therefore, a force can be transmitted to the coil or a voltage can be induced in the coil.

Figure 4:
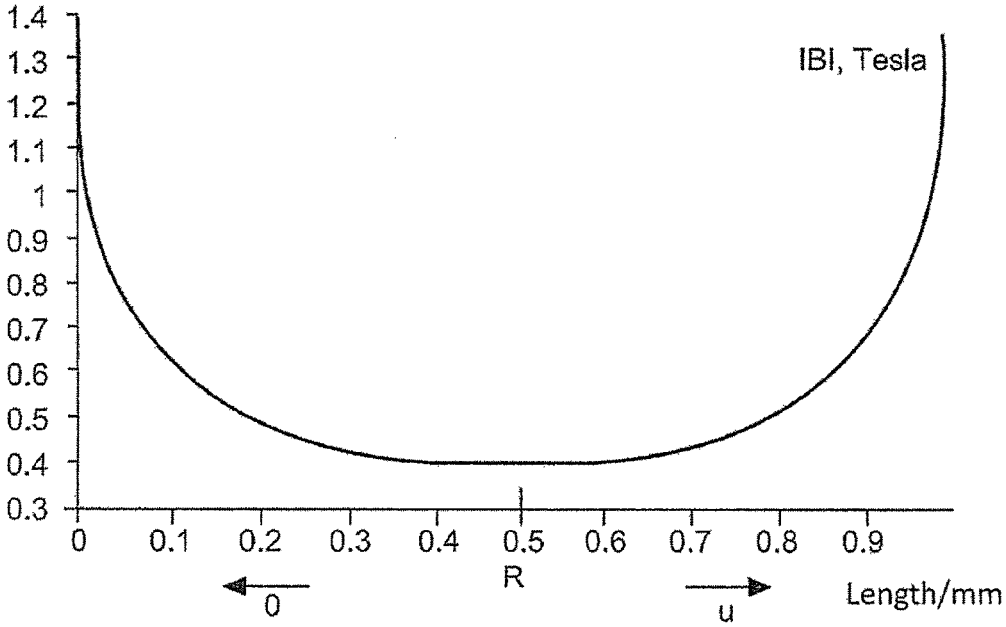
FIG. 4 shows a graph depicting the curve of the flux density.

FIG. 4 shows a graph depicting the curve of the flux density in the situation shown in FIG. 3. In FIG. 4, the length is shown in mm on the X axis and the flux density is shown on the Y axis. The center of the air gap is located at approximately 0.5 mm in the neutral position. The excursion of the coil is mechanically limited by the spacing between the diaphragm 140 and the resonator 120 and between the diaphragm 140 and the frame 110. The voice coil 130 moves, according to the invention, in a linear region of the flux density characteristic line.

Optionally, the coil 130 is located in the center between the first magnet ring 150 and second magnet ring 160. Optionally, the inner diameter of the coil corresponds to the outer diameter of the magnet rings. The flux density characteristic line on which the coil operates can be determined from the radial position of the coil.

Figure 5:
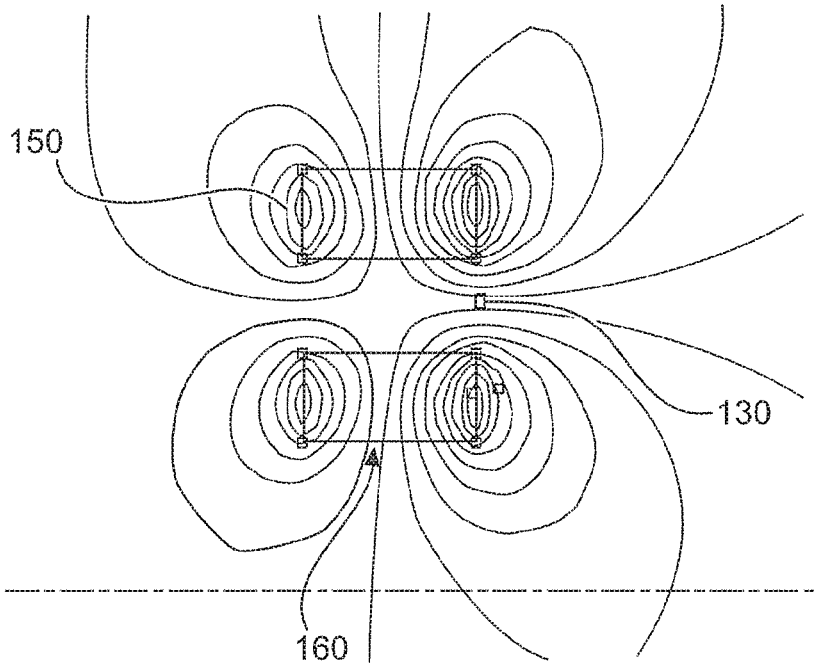
FIG. 5 shows a schematic diagram of a first magnet ring and second magnet ring and a voice coil in an electrodynamic sound transducer according to a first embodiment example.

FIG. 5 shows a schematic diagram of the first magnet ring and second magnet ring and the field lines of the magnetic field of the first magnet ring 150 and second magnet ring 160. It will be seen that the magnetic field lines at the locations to the left and right of the first magnet ring 150 and second magnet ring 160 run substantially parallel to a diaphragm 140 to be provided there. In particular, there are field lines oriented perpendicular to the voice coil between the first magnet ring 150 and second magnet ring 160 on the outer diameter of the magnet rings 150, 160. Therefore, a force can be transmitted to the coil or a voltage can be induced in the coil.

Figure 6:
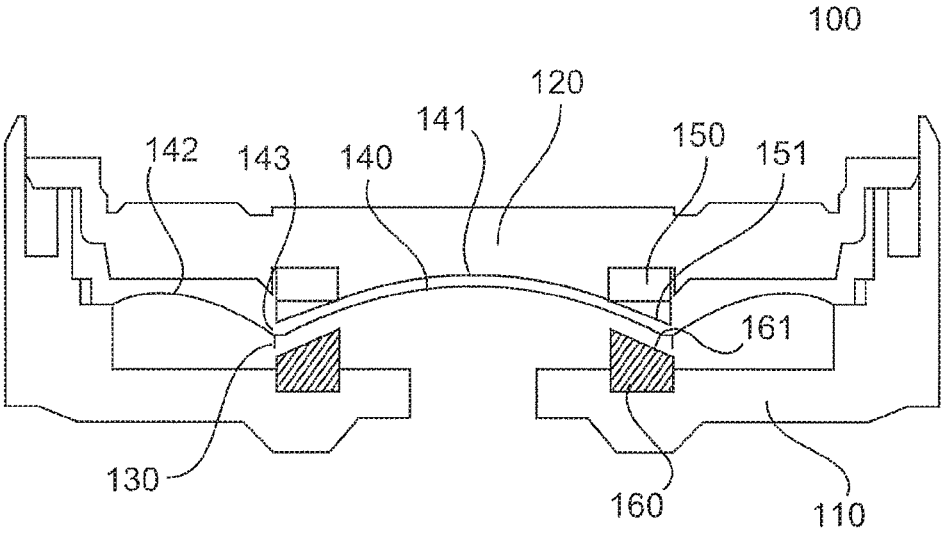
FIG. 6 shows a schematic sectional view of an electrodynamic sound transducer according to a second embodiment example.

FIG. 6 shows a schematic sectional view of an electrodynamic sound transducer according to a second embodiment example. The electrodynamic sound transducer 100 has a frame 110, optionally a resonator 120, and a diaphragm 140 (with a dome 141, a surround 142 and a transitional area 143 between the dome 141 and the surround 142). A voice coil 130 is provided in the transitional area 143. The electrodynamic sound transducer further has first magnet ring 150 and second magnet ring 160, the first magnet ring 150 is located above the diaphragm 140 and the second magnet ring 160 is located below the diaphragm 140. According to the second embodiment example, the first magnet ring 150 has a beveled end 151, and the second magnet ring 160 also has a beveled end 161. The beveled ends face toward the diaphragm in each instance. By changing the cross section of the rings, the first magnet ring and second magnet ring can be adapted to the geometry of the diaphragm. Accordingly, the flux density can be increased and the curve can be linearized over a large range.

Figure 7:
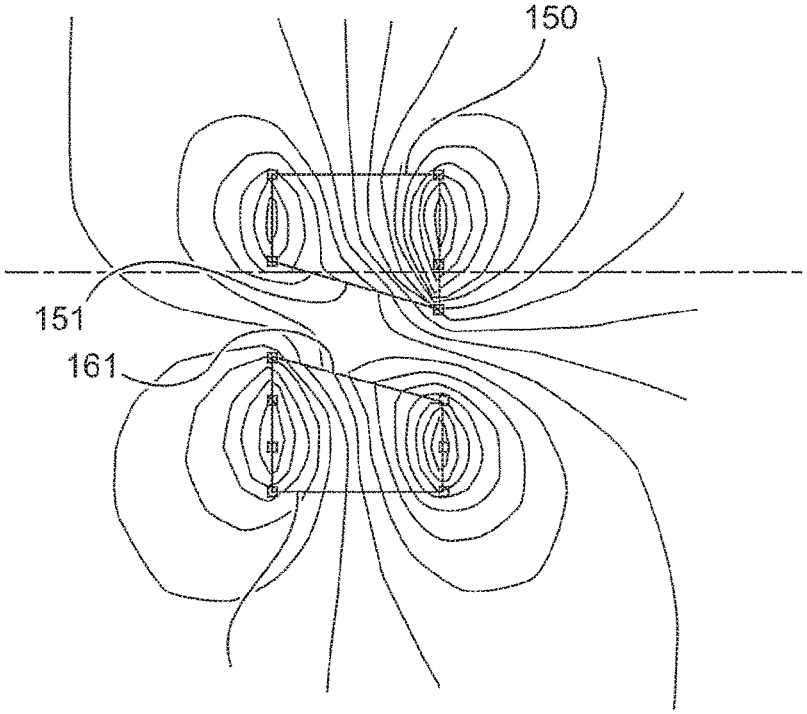
FIG. 7 shows a schematic diagram of two magnet rings in an electrodynamic sound transducer according to the second embodiment example.

FIG. 7 shows a schematic diagram of a first magnet ring and second magnet ring and the magnetic field line in an electrodynamic sound transducer according to a second embodiment example. As a result of the beveled end 151 of the first magnet ring 150 and the beveled ends 161 of the second magnet ring 160, there is a shifting of the magnetic field lines (compared to the field lines in FIG. 5) so that there is also a shifting of those areas of the magnetic field lines which are arranged perpendicular to the voice coil. Compared to the first embodiment example (FIG. 5), the magnet rings 150, 160 can be brought closer together. This results in an increase in the magnetic flux density and, therefore, an increase in the Bl factor.

According to an aspect of the present invention, the change in cross section can also always be implemented by installing a pole piece with an appropriate geometry.

With the electrodynamic sound transducer according to the invention, a substantial reduction in vibrating mass (diaphragm mass and coil mass) can be achieved. This allows the frequency response to be expanded to higher frequencies. Further, the acoustically interfering influence of the air gap can be reduced. Moreover, an improved transient response of the dynamic transducer (transients fidelity) can be achieved by the electrodynamic sound transducer according to the invention. Further, the acoustical properties of a ribbon transducer can be maintained with a mechanically more robust construction. According to the invention, the diaphragm can optionally be glued in along the entire periphery so that the front and back are sealed. This is impossible in a ribbon microphone. Further, a construction as directional microphone with the conventional technologies can also be possible.

According to the invention, the voice coil and the lead of the voice coil can be vapor-deposited or deposited in some other way on the diaphragm. A low-mass coil can be realized in this way.

The electrodynamic transducer according to the invention can be configured as a receiving transducer, e.g., a microphone, or a reproduction transducer, e.g., a loudspeaker, or as an electrodynamic reproduction transducer for headphones or an earpiece.

Figure 8:
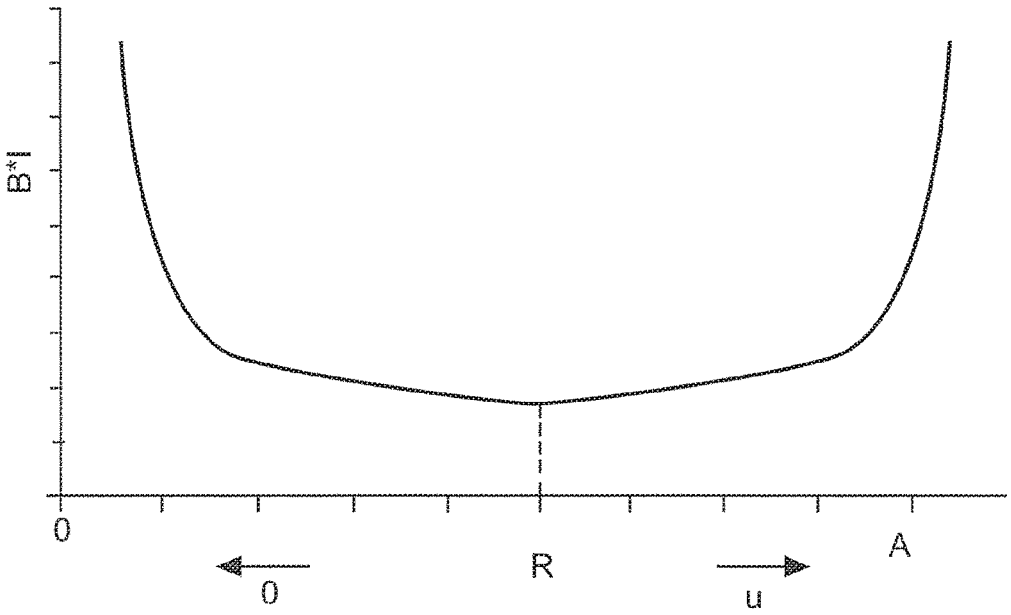
FIG. 8 shows a graph depicting the Bl factor as a function of an excursion of the diaphragm.
Figure 9A:
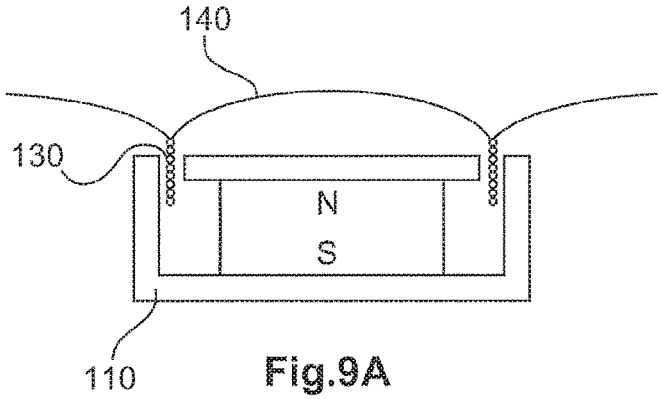
FIG. 9A shows a schematic diagram of an electrodynamic sound transducer according to the prior art.
Figure 9B:
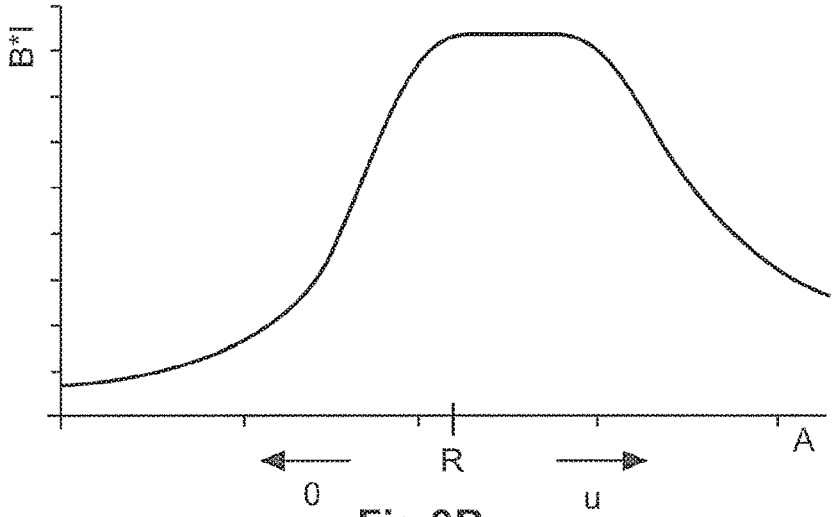
FIG. 9B shows a graph depicting the Bl factor as a function of excursion for an electrodynamic sound transducer according to the prior art.

FIG. 8 shows a graph depicting the Bl factor as function of an excursion of the diaphragm. In FIG. 8, the curve of the Bl factor is shown over the excursion A in mm of the diaphragm of an electrodynamic sound transducer according to the invention. A comparison of the curve of the Bl factor according to the invention (FIG. 8) to the Bl curve according to prior art (FIG. 9B) shows that the Bl curve is substantially more consistent and symmetrical with respect to the neutral position over a substantially greater excursion range. This results in lower distortion.

The sound transducer according to the invention is advantageous because of the low mass of the voice coil. An improved transient response is also made possible in this way. All of the windings of the coil are situated in the actual useful flux of the air gap and accordingly also contribute to the electromechanical conversion.

The sound transducer according to the invention is likewise advantageous because the slots in the air gap between voice coil and pole piece/cup are dispensed with, and the problems associated with them no longer occur. Further, a wobbling movement of the diaphragm through the flat coil can no longer cause knocking against the magnet system.

The curve of the Bl factor according to FIG. 8 is essentially the inverse of the curve of the compliance and therefore counters the inhibition of the diaphragm movement through the drop-off in compliance at greater excursions. This results in a linear response during greater excursions.

Further, the configuration, according to the invention, of the sound transducer is advantageous because there is a smaller space requirement for the magnets. The invention can be realized with only two magnets.

According to the invention, the dome can also be constructed such that it moves in a piston-like manner over the entire useful frequency range. Further, a greater stability can be achieved as a result of the curved contour. The voice coil can be fixedly connected to the diaphragm at the outer edge of this area. In this way, it can be ensured that the entire dome area moves uniformly and in phase.

Further, the surround area of the diaphragm can be configured such that the compliance of the diaphragm can be adjusted.

Figure 10:
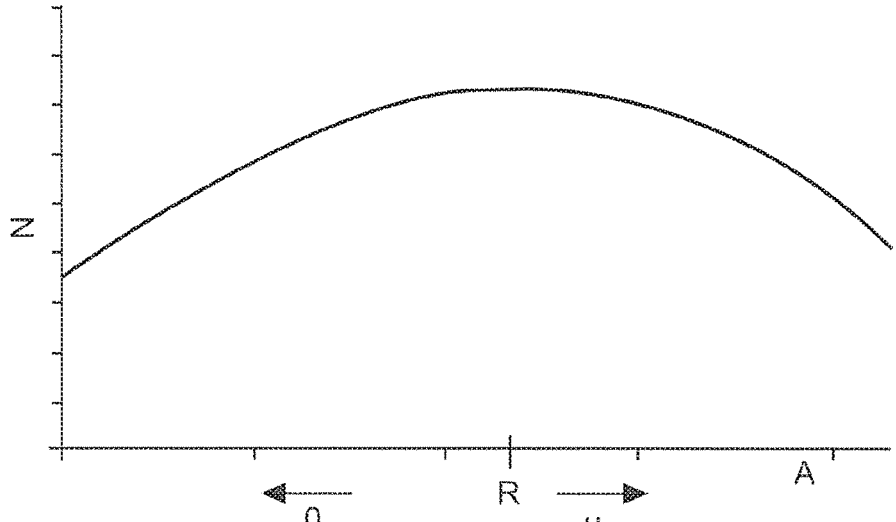
FIG. 10 shows a graph depicting the compliance of a diaphragm as function of the excursion for an electrodynamic sound transducer according to the prior art.

FIG. 10 shows a graph depicting the compliance of a diaphragm as function of the excursion for an electrodynamic sound transducer. The compliance is substantially more balanced compared to the prior art.

The electrodynamic sound transducer according to the invention can be used in an earpiece or headphones or in a microphone. Accordingly, the invention is likewise directed to an earpiece or headphones with an electrodynamic sound transducer described above or a microphone with an electrodynamic sound transducer described above.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An electrodynamic sound transducer comprising:

a diaphragm forming a closed surface, the diaphragm comprising:

a dome; and a surround;

a voice coil that is fastened to the diaphragm;

a first magnet ring defining a first plane on one side of the diaphragm;

a second magnet ring defining a second plane on a second side of the diaphragm;

wherein the voice coil or the dome is arranged between the first plane and second plane;

wherein a magnetization direction of the first magnet ring is opposite to a magnetization direction of the second magnet ring;

wherein the first magnet ring is beveled at a side facing the diaphragm, and the second magnet ring is beveled at a side facing the diaphragm, and beveled sides of the first and second magnet rings are adapted to a geometry of the diaphragm;

wherein, in cross section, the beveled side of the first magnet ring is parallel to the beveled side of the second magnet ring; and wherein an inner diameter of the voice coil substantially corresponds to an outer diameter of the first magnet ring, an outer diameter of the second magnet ring, or both.

2. The electrodynamic sound transducer according to claim 1;

wherein the first magnet ring is arranged in a resonator and the second magnet ring is arranged on a frame.

3. The electrodynamic sound transducer according to claim 1;

wherein a diameter of the first magnet ring corresponds to a diameter of the second magnet ring.

4. The electrodynamic sound transducer according to claim 1;

wherein the diaphragm has a flat dome or a flat coil seat.

5. The electrodynamic sound transducer according to claim 1;

wherein at least one of the voice coil and a lead thereof is printed on the diaphragm.

* * * * *